United States Patent [19]

D'Intino et al.

[11] Patent Number: 4,622,046

[45] Date of Patent: Nov. 11, 1986

[54] STABILIZED HIGH SOLIDS, COAL-OIL MIXTURES AND METHODS FOR THE PRODUCTION THEREOF

[75] Inventors: Joseph D'Intino, Parkside; Carl E. Eckman, Springfield; Lester E. Burgess, Swarthmore, all of Pa.

[73] Assignee: The Standard Oil Company, Cleveland, Ohio

[21] Appl. No.: 431,585

[22] Filed: Sep. 30, 1982

[51] Int. Cl.[4] ..... C10L 1/32

[52] U.S. Cl. ..... 44/51; 44/62; 44/66; 44/68

[58] Field of Search ..... 44/51, 62, 66, 68

[56] References Cited

U.S. PATENT DOCUMENTS

| | | | |
|---|---|---|---|
| 3,617,095 | 11/1971 | Limont | 44/51 X |
| 3,762,887 | 10/1973 | Clancey et al. | 44/51 |
| 4,033,852 | 7/1977 | Horowitz et al. | 208/8 |
| 4,101,293 | 7/1978 | Krause et al. | 44/51 |
| 4,217,109 | 8/1980 | Siwersson et al. | 44/51 X |
| 4,251,229 | 2/1981 | Naka et al. | 44/51 |
| 4,304,573 | 12/1981 | Burgess et al. | 44/51 |
| 4,306,883 | 12/1981 | Eckman | 44/51 |
| 4,332,593 | 6/1982 | Burgess et al. | 44/51 |

FOREIGN PATENT DOCUMENTS

| | | | |
|---|---|---|---|
| 1523193 | 8/1978 | United Kingdom | 44/51 |
| 2079784A | 1/1982 | United Kingdom | 44/51 |

OTHER PUBLICATIONS

Encyclopedia of Chemical Technology, Kirk-Othmer, Third Edition (1980), vol. 11, pp. 410–422 and 449–473.

U.S. Government Report No. 2694 entitled "Fuel Extension by Dispersion of Clean Coal in Oil".

*Primary Examiner*—William R. Dixon

*Assistant Examiner*—Margaret B. Medley

*Attorney, Agent, or Firm*—Bruce E. Harang; David J. Untener; Larry W. Evans

[57] ABSTRACT

Stabilized high solids content coal-oil mixtures are provided by the admixture of coal and oil in the presence of a saturated or unsaturated fatty acid and a gel-forming agent under selected conditions of admixture.

15 Claims, No Drawings

STABILIZED HIGH SOLIDS, COAL-OIL MIXTURES AND METHODS FOR THE PRODUCTION THEREOF

BACKGROUND OF THE INVENTION

This invention relates to coal and more particularly to stabilized coal-oil-mixtures and process for the production thereof.

Known resources of coal and other solid carbonaceous fuel materials in the world are far greater than the known resources of petroleum and natural gas combined. Despite this enormous abundance of coal and related solid carbonaceous materials, reliance on these resources, particularly coal, as primary sources of energy, has been for the most part discouraged. The availability of cheaper, cleaner burning, more easily retrievable and transportable fuels, such as petroleum and natural gas, has in the past, cast coal to a largely supporting role in the energy field.

Current world events, however, have forced a new awareness of global energy requirements and of the availability of those resources which will adequately meet these needs. The realization that reserves of petroleum and natural gas are being rapidly depleted in conjunction with skyrocketing petroleum and natural gas prices and the unrest in the regions of the world which contain the largest quantities of these resources, has sparked a new interest in the utilization of solid carbonaceous materials, particularly coal, as primary energy sources.

As a result, enormous efforts are being extended to make coal and related solid carbonaceous materials equivalent or better sources of energy, than petroleum or natural gas. In the case of coal, for example, much of this effort is directed to overcoming the environmental problems associated with its production, transportation and combustion. For example health and safety hazards associated with coal mining have been significantly reduced with the onset of new legislation governing coal mining. Furthermore, numerous techniques have been explored and developed to make coal cleaner burning, more suitable for burning and more readily transportable.

Gasification and liquefaction of coal are two such known techniques. Detailed descriptions of various coal gasification and liquefaction processes may be found, for example, in the *Encyclopedia of Chemical Technology.* Kirk-Othmer, Third Edition (1980) Volume 11, pages 410–422 and 449–473. Typically, these techniques, however, require high energy input, as well as the utilization of high temperature and high pressure equipment, thereby reducing their widespread feasibility and value.

Processes to make coal more readily liquefiable have also been developed. One such process is disclosed in U.S. Pat. No. 4,033,852 (Horowitz, et al.). This process involves chemically modifying a portion of the surface of the coal in a solvent media, the effect of which renders the coal more readily liquefiable in a solvent than natural forms of coal, thereby permitting recovery of a liquefiable viscous product by extraction.

In addition to gasification and liquefaction, other methods for converting coal to more convenient forms for burning and transporting are also known. For example, the preparation of coal-oil and coal-aqueous mixtures are described in the literature. Such liquid coal mixtures offer considerable advantages. In addition to being more readily transportable than dry solid coal, they are more easily storable, and less subject to the risks of explosion by spontaneous ignition. Moreover, providing coal in a fluid form makes it feasible for burning in conventional apparatus used for burning fuel. Such a capability can greatly facilitate the transition from fuel oil to coal as a primary energy source.

Typical coal-oil and coal-aqueous mixtures and their preparation are disclosed in U.S. Pat. Nos. 3,762,887, 3,617,095, 4,217,109 and British Patent No. 1,523,193. Additionally, U.S. Pat. No. 4,101,293 discloses coal-oil mixtures prepared from the admixture of a preformed stabilizing emulsifier comprised of the reaction product of an ethylenically unsaturated acid, such as tall oil, with an alkali hydroxide or alkanol amine, with pulverized coal and oil. Similarily, British Patent application No. 2079784A discloses coal-oil suspensions prepared from admixing coal and fuel oil with a preformed stabilizer comprised of a partially amidated copolymer obtained by reacting a copolymer of a polymerizable, unsaturated hydrocarbon and maleic anhydride with a saturated or unsaturated aliphatic amine or salt thereof. U.S. Pat. No. 4,251,229 is an example of coal-oil mixtures stabilized with high molecular weight adducts of alkylene oxide and an alcohol, an amine, a carboxylic acid or phenol having at least three active hydrogens.

In addition, U.S. patent application Ser. No. 230,055 filed Jan. 29, 1981, discloses a process for the production of stabilized coal-oil mixtures wherein pulverized coal is admixed with oil, a polymerizable fatty acid ester, such as tallow, and a polymerization catalyst therefor, under polymerization reaction conditions, and a stabilizing agent-forming amount of a gelling agent, such as an alkali metal hydroxide or ammonium hydroxide. Furthermore, U.S. Pat. No. 4,306,883 discloses that stable coal-oil mixtures can be formed from high water content coal by mixing said coal with oil, a monomeric compound, such as tall oil, and a chemical surface treatment agent, heating the mixture to an elevated temperature, subjecting the coal-oil mixture to a condition of low shear to form a low sheared coal-oil mixture, subjecting the low sheared coal-oil mixture to a condition of high shear and admixing a gelling agent, such as, alkali metal hydroxide or ammonium hydroxide to form a stable coal-oil mixture in the form of a gel or thixotropic mixture.

Moreover, U.S. Pat. No. 4,304,573 and United States Government Report No. 2694 entitled "Fuel Extension by Dispersion of Clean Coal in Fuel Oil", all incorporated herein by reference, inter alia, disclose a chemical surface treatment technique for forming coal into a coal-oil mixture. In summary, according to this chemical treatment method, coal is first cleaned of rock and the like and pulverized to a fine size of about 48 to 300 mesh. The pulverized coal, now in the form of a water slurry, is then treated with a monomeric compound, usually in the presence of a liquid organic carrier, and reaction addivite. The chemical treatment of the coal is adapted to make the coal both hydrophobic and oleophilic. Coal particles so treated are readily separated from unwanted ash and sulfur using oil and water separation techniques. The coal, which is now substantially cleaned of ash and sulfur, is then preferably dried to a water content level suitable for further processing or recovery. The dried coal is thereafter formed into a coal-oil mixture, where it can again be subjected to a chemical surface treatment using additional additive.

The coal-oil mixture is thereafter treated with a gelling agent to form the coal-oil mixture in the form of a stable mixture, typically gel or thixotropic. The coal-oil mixture product thus produced is advantageously non-settling and enjoys a dispersion stability normally difficult to achieve and maintain without frequent stirring, the addition of further additives or an inordinate amount of fine grinding. In addition, the mixture thus formed can be thixotropic, allowing for ready pumpability on subjection to shearing or pumping forces.

It will be seen that this afore-described chemical surface treatment technique, such as disclosed in U.S. Pat. No. 4,304,573 offers considerable advantages in providing coal as a useful energy source. Although the technique is attractive, it is still desirable to make the process even more advantageous. For example, it would be highly desirable if the amount of drying, which the cleaned coal is subjected to prior to forming the coal-oil mixture could be reduced, without adversely affecting the gel forming process. Such a decrease in drying would significantly improve the overall efficiency of the process, and advantageously would reduce or eliminate the need for burdensome and expensive drying equipment, such as large scale thermal dryers. The use of thermal drying equipment, e.g., is both expensive and time consuming, particularly in large scale coal processing operations. Thus, the necessity for the use of drying equipment could seriously detract from an otherwise attractive process.

While many of these aforementioned procedures produce excellent stabilized coal-oil mixtures, improved formulations and procedures for the production thereof are still desirable, particularly those formulations and procedures providing high solids, i.e., high coal content mixtures, prepared from simple, cost reduced processes.

SUMMARY OF THE INVENTION

Accordingly, it is one object of the present invention to provide stable coal-oil mixtures.

Another object of this invention is to provide stable coal-oil mixtures having high solids coal content.

A further object of the present invention is to provide stable coal-oil mixtures having high solids content, using coal having a high water content.

Another object of the present invention is to provide a stable coal-oil mixtures, having high coal solids loadings, which are readily pumpable and which are stable over extended periods.

A still further object of this invention is to provide a method for forming stable coal-oil mixtures, in, e.g., gel or thixotropic form, having higher solids coal content than heretofore achieved and adapted to employ coal of relatively high water content.

Still another object of the present invention is to provide a method for the production of highly stable coal-oil mixtures, utilizing less expensive additives and reduced process steps than heretofore employed.

These and other objects are achieved herein by providing a coal-oil mixture prepared by admixing coal, oil, and unsaturated or saturated carboxylic fatty acid and a gel forming amount of a base selected from the group consisting of an alkali metal hydroxide, an alkaline earth metal hydroxide, ammonium hydroxide and amines.

DETAILED DESCRIPTION OF THE INVENTION

In accordance with the present invention, it has been surprisingly discovered that storage stable coal-oil mixtures, having especially high coal solids content, can be readily formed by utilizing certain selected conditions and gel forming additives. The coal-oil mixtures prepared according to the present invention are adapted for use in furnaces to produce heat energy, etc. and are particularly attractive since not only do they utilize less of the more expensive component, i.e. oil, they can be desirably stored for long periods of time, without separation of the components, under a wide variety of the temperature ranges. Moreover, the coal-oil mixtures prepared according to this invention can be readily pumped through pipelines and/or transported by truck, rail, or otherwise without need for special handling and without undue deleterious sedimentation of the coal from the oil.

More particularly, the improved coal-oil mixtures of this invention are provided by admixing coal, preferably high moisture content coal or wet coal, fuel oil, a saturated or unsaturated fatty acid and a gel forming agent, such as ammonium hydroxide. Thus, in contrast to the process of said U.S. Pat. No. 4,306,883 high solids content coal-oil mixtures, for example, as high as 70% coal, can be formulated without special processing conditions, such as high shear agitation.

While variations in the formulation procedure are contemplated, the stable coal-oil mixtures of the present invention are preferably prepared by initially mixing oil, such as crude oil or heavy oil, for example, Nos. 2–6 fuel oils, using conventional mixers and mixing techniques, with the saturated or unsaturated fatty acid and heating this initial admixture to an elevated temperature, for example, in the range of from about 130° to about 210° F., preferably about 150° F., for a time sufficient to thoroughly admix the materials, as, e.g., 1 to about 5 minutes. Then, at least a portion of the total coal to be added is introduced to this heated fuel oil-fatty acid mixture with stirring. Preferably, the coal has been cleaned of rock and has been pulverized before being admixed. Moreover, it has been surprisingly found herein that the use of wet coal, i.e. coal which has a moisture content, for example, of from about 10 to about 30% and/or coal with a lower moisture content but which has been slurried in water to wet the surface thereof, (excess water is filtered off), in the preparation of the coal-oil mixture, results in higher solids content coal oil mixtures. The gel forming base, such as ammonium hydroxide, is then added, with stirring, to this initial coal-oil mixture and thereafter the remaining portion of the pulverized coal is added to the blend. If desired, further amounts of the gel forming base can also be added at this point.

It has also been observed herein that the gradual or portionwise addition of the wet coal, although not absolutely necessary, provides better stability and higher loadings to the coal-oil mixture. Thus, for example, initially from about 20% to about 80% coal of the total coal to be added is admixed with the oil. The remainder of the coal to be added is added subsequent to the addition of the gel forming base, as described. The entire mixture is then heated to a temperature in the range of from about 130° to about 170° F., preferably about 150°, with stirring.

Any type coal can be employed in the preparation of the coal-oil mixtures of the present invention. Typically, these include, for example, bituminous coal, subbituminous coal, anthracite, lignite, and the like. Other solid carbonaceous fuel materials, such as oil shale, tar sands, coke, carbon black, graphite, mine tailings, coal from refuse piles, coal processing fines, coal fines from mine ponds or tailings, carbonaceous fecal matter and the like are also contemplated for use herein. Thus, for the purposes of this invention, the term "coal" is also intended to include these kinds of other solid carbonaceous fuel materials.

Moreover, the coal utilized in the preparation of the coal-oil mixtures of this invention may be beneficiated or unbeneficiated. For obvious reasons, it is preferred that the coal be beneficiated. Furthermore, a preferred beneficiated coal for the purposes of this invention is that coal which has been beneficiated by the process disclosed, for example, in U.S. Pat. No. 4,304,573 and in copending U.S. application Ser. No. 431,584, filed Sept. 30, 1982, the teachings of which are incorporated herein by reference. These beneficiation processes involve aqueous washings and since the coal-oil mixtures of the present invention are advantageously prepared with water wet coal, the coal beneficiated by these processes need not even be dried or only partially dried prior to being used in the preparation of the present coal-oil mixtures.

The oil or fuel oil mixed with the coal herein can be any of a wide variety of petroleum crude oil and liquid fractions thereof. Typical fuel oils utilized herein include Nos. 1–6 fuel oil, kerosene, light oils, heavy oils, cracked residue of ethylene; coal tar fractions, such as creosote oil and anthracene oil; various waste oils such as motor oils, lubricants, machine oils, cutting oils, cleaning oils, waste oils, such as from chemical plants and mixtures of the foregoing.

The fatty acids, which are employed in the preparation of the coal-oil mixtures herein and which are believed to react with the base, such as ammonium hydroxide, are typically any of the well known saturated or unsaturated fatty acids or compositions known to contain the same.

Illustratively, the fatty acids contemplated by the present invention have the general formula.

$$RC(=O)-OH \quad \text{(I)}$$

wherein R is a saturated or an olefinically unsaturated organic radical, preferably containing from about 1 to about 30 carbon atoms. Saturated fatty acids within the above formula (I) have the general formula $C_nH_{2n+1}COOH$, wherein n is, for example, 1 to about 30. Unsaturated fatty acids within the above formula (I) have the general formula $$C_nH_{2n-1}COOH \text{ or } C_nH_{2n-3}COOH \text{ or } C_nH_{2n-5}COOH$$

wherein n is as defined before. Saturated and unsaturated cycloaliphatic carboxylic acids are also contemplated herein.

Specific examples of fatty acids conforming to the foregoing structural formulae, and which are useful in carrying out the present invention include, saturated fatty acids, such as butanoic acid, hexanoic acid, (caproic acid), octanoic acid, decanoic acid, dodecanoic acid (lauric acid), tetradecanoic acid (myristic acid), hexadecanoic (palmitic acid) octadecanoic acid (stearic acid) and the like. Typical, unsaturated fatty acids useful herein, include oleic acid, linoleic acid, linolenic acid, ricinoleic acid, unsaturated vegetable seed oil, cottonseed oil, soybean oil, rosin acids, dehydrated castor oil, linseed oil, olive oil, peanut oil, tall oil, corn oil and the like and mixtures of all of the foregoing. For the purposes of this invention, tall oil or oleic acid are preferred. Tall oil is most preferred.

Gel forming bases, which may be utilized herein, include ammonium hydroxide, alkali metal and alkaline earth metal hydroxides, such as sodium hydroxide, potassium hydroxide, calcium hydroxide, magnesium hydroxide and mixtures thereof. While ammonium hydroxide is the preferred base additive, various amines are also contemplated herein. These amines include alkanolamines such as monoethanolamine, triethanolamine, isopropanolamine, isomers thereof, diethanolamine and the like and blends of these amines.

The amount of the base and fatty acid employed in the preparation of the coal-oil mixtures of the present invention can vary over a wide range. Generally, the amount of base necessary is in slight excess of that required to neutralize the available acidic hydrogens of the fatty acid. More particularly, if ammonium hydroxide, alkali metal hydroxide or alkaline earth metal hydroxide are used, from about 0.1 to about 0.5 parts by weight to 1 part by weight fatty acid are employed, depending upon the molecular weight of the hydroxide. If an amine is used then the amount used by weight is dependent upon the molecular weight of the amine. Preferably, when tall oil and ammonium hydroxide are employed, from about 0.3 to about 0.6 parts ammonium hydroxide are used per part, by weight, of tall oil.

As stated hereinbefore, the coal utilized in the preparation of the herein disclosed coal-oil mixtures can be a moisture containing or water wet coal. Thus, for the purposes of this invention, it is preferred that the coal have a water (moisture) content of from about 10 to about 30% or be wetted with water prior to dispersion in the oil.

In preparing the coal-oil mixtures herein, the ratio of coal to oil employed is generally from about 40/60 to about 80/20. Preferably, by employing the teachings herein, coal-oil mixtures having 70 parts, by weight, coal to 30 parts by weight oil, having excellent long term stability, are provided.

Furthermore, while not absolutely necessary, other additives, such as polymerizable monomers and/or polymerization catalysts may be employed in the preparation of the coal-oil mixtures of the present invention. For example, during the admixture of the coal, oil, fatty acid and base, a catalyst, such as, is commonly used in polymerization reactions may also be added. These catalysts include, for example, anionic, cationic or free radical catalysts. Free radical catalysts or catalyst systems (also referred to as addition polymerization initiators) are preferred herein. Thus, illustratively, free radical catalysts contemplated herein include, for example inorganic and organic peroxides, such as benzoyl peroxide, methylethyl ketone peroxide, tert-butylhydroperoxide, hydrogen peroxide, air, oxygen, ammonium persulfate, ditert-butyl-peroxide, tert-butyl-perbenzoate, peracetic acid and including such non-peroxy free-radical initiators as the diazo compounds, such as 1,1'-bisazoisobutyronitrile and the like. Typically, for the purposes of this invention amounts of from about 10 to about 200 ppm of the foregoing described catalysts may be utilized herein.

Moreover, free radical initiators, which function to help initiate the free radical reaction, may also be added during the coal-oil mixture preparation herein. Specifically, some of these initiators include, for example, water soluble salts, such as sodium perchlorate and perborate, sodium persulfate, postassium persulfate, ammonium persulfate, silver nitrate, water soluble salts of noble metals such as platinum and gold, sulfites, nitrites and other compounds containing the like oxidizing anions, and water soluble salts of iron, nickel, chromium, copper, mercury, aluminum, cobalt, manganese, zinc, arsenic, antimony, tin, cadmium, and the like. Particularly preferred initiators herein are the water soluble copper salts, i.e. cuprous and cupric salts, such as copper acetate, copper sulfate and copper nitrate. Cupric nitrate, $Cu(NO_3)_2$ is most preferred. Other initiators useful herein, include, metal salts of organic moities, typically metal salts of organic acids or compositions containing organic acids, such as naphthenates, tallates, octanoates, etc. and other organic soluble metal salts, said metals including copper, chromium, mercury, aluminum, antimony, arsenic, cobalt, manganese, nickel, tin, lead, zinc, rare earths, mixed rare earths, and mixtures thereof and double salts of such metals. The amounts of free radical initiator contemplated herein include 10 to 200 ppm.

It should be understood that these aforenoted free radical catalysts and/or initiators are not necessary to the present process and if employed may be utilized individually or in combination.

Polymerizable monomers (also not necessary) may also be added if desired during the coal-oil mixture preparation herein. Thus, monomers contemplated for this purpose may be characterized by the formula XHC=CHX' wherein X and X' each may be hydrogen or any of a wide variety of organic radicals or inorganic substituents. Illustratively, such monomers include ethylene, propylene, butylene, tetrapropylene, isoprene, butadiene, such as 1,4-butadiene, pentadiene, dicyclopentadiene, octadiene, olefinic petroleum fractions, styrene, vinyltoluene, vinylchloride, vinylbromide, acrylonitrile, with acrylonitrile, acrylamide, methacrylamide, N-methylolacrylamide, acrolien and the like. These polymerizable monomers can be added at any time, such as during admixture of the coal with oil, or such monomers can be introduced in coal pretreatment, such as in beneficiation.

In order that those skilled in the art may better understand how to practice the present invention, the following examples are given by way of illustration and not by way of limitation.

EXAMPLE 1

120 grams of No. 6 fuel oil is mixed with 4.8 grams of tall oil and the mixture is heated to about 180° F. 180 grams (dry weight) of pulverized coal having an ash content of 1-8% and a moisture content of 25% is mixed into the heated tall oil-fuel oil mixture. 2.4 ml. of a 28% $NH_4OH$ (ammonium hydroxide) aqueous solution is then introduced to the coal-oil admixture and the mixture is heated at about 150° F. The remainder of the coal, i.e., 100 grams, dry weight, is then slowly added to the mixture under paddle type mixing conditions, for example as provided by a Eastern Heavy Duty Mixer, Model 5UB. A thick gel, (having a fluffy appearance, which does not attach to the sidewalls of the vessel) and which is readily flowing upon being subjected to shearing or pumping forces, is formed. The resultant coal-oil mixture is highly storage stable, e.g. shelf life of 3 months or more and contains 70 parts, by weight, coal to 30 parts, by weight, oil.

EXAMPLE 2

160 grams of No. 6 fuel oil is mixed with 4.8 grams of tall oil and the mixture is heated to about 180° F. 140 grams (dry weight) of pulverized (Wells Blend) coal having a moisture content of 20% is mixed into the heated tall oil-fuel oil mixture. 2.4 ml. of a 28% $NH_4OH$ (ammonium hydroxide) aqueous solution is then introduced to the coal-oil admixture and the mixture is heated at about 150° F. The remainder of the coal, i.e., 100 grams, dry weight, is then slowly added to the mixture under paddle type mixing conditions, for example as provided by an Eastern Heavy Duty Mixer MODEL 5UB. A thick gel, (having a fluffy appearance, which does not attach to the sidewalls of the vessel) and which is readily flowing upon being subjected to shearing or pumping forces, is formed. The resultant coal-oil mixture is highly storage stable, e.g. shelf life of 3 months or more and contains 60 parts, by weight, coal to 40 parts by weight oil.

EXAMPLE 3

140 grams of No. 6 fuel oil is mixed with 5.6 grams of tall oil and the mixture is heated to about 200° F. 160 grams (dry weight) of pulverized (Wells Blend) coal having a moisture content of 20% is mixed into the heated tall oil-fuel oil mixture. 2.8 ml. of a 28% $NH_4OH$ (ammonium hydroxide) aqueous solution is then introduced to the coal-oil admixture and the mixture is heated at about 150° F. The remainder of the coal, i.e., 100 grams, dry weight, is then slowly added to the mixture under paddle type mixing conditions, for example as provided by an Eastern Heavy Duty Mixer MODEL 5UB. A thick gel, (having a fluffy appearance, which does not attach to the sidewalls of the vessel) and which is readily flowing upon being subjected to shearing or pumping forces, is formed. The resultant coal-oil mixture is highly storage stable, e.g. shelf life of 3 months or more and contains 65 parts, by weight, coal to 35 parts by weight oil.

EXAMPLE 4

140 grams of No. 6 fuel oil is mixed with 2.8 grams of tall oil and the mixture is heated to about 200° F. 160 grams (dry weight) of pulverized (Wells Blend) coal having a moisture content of 20% is mixed into the heated tall oil-fuel oil mixture. 1.4 ml. of a 28% $NH_4OH$ (ammonium hydroxide) aqueous solution is then introduced to the coal-oil admixture and the mixture is heated at about 150° F. The remainder of the coal, i.e., 100 grams, dry weight, is then slowly added to the mixture under paddle type mixing conditions, for example as provided by an Eastern Heavy Duty Mixer, MODEL 5UB. A thick gel, (having a fluffy appearance, which does not attach to the sidewalls of the vessel) and which is readily flowing upon being subjected to shearing or pumping forces, is formed. The resultant coal-oil mixture is highly storage stable, e.g. shelf life of 3 months or more and contains 65 parts, by weight, coal to 35 parts by weight oil.

EXAMPLE 5

100 grams of No. 6 fuel oil and 20 grams of No. 2 fuel oil is mixed with 4.8 grams of tall oil and the mixture is heated to about 200° F. 180 grams (dry weight) of pulverized (Wells Blend) coal having a moisture content of 25% is mixed into the heated tall oil-fuel oil mixture. 3.0 ml. of a 28% $NH_4OH$ (ammonium hydroxide) aqueous solution is then introduced to the coal-oil admixture and the mixture is heated at about 150° F. The remainder of the coal, i.e., 100 grams, dry weight, is then slowly added to the mixture under paddle type mixing conditions, for example as provided by an Eastern Heavy Duty Mixer, MODEL 5UB. A thick gel, which is readily flowing upon being subjected to shearing or pumping forces, is formed. The resultant coal-oil mixture is highly storage stable, e.g. shelf life of 3 months or more and contains 70 parts by weight, coal to 30 parts by weight oil.

EXAMPLE 6

160 grams of No. 6 fuel oil is mixed with 4.8 grams of tall oil and the mixture is heated to about 200° F. 240 grams (dry weight) of pulverized Homer City coal having a moisture content of 20% is mixed into the heated tall oil-fuel oil mixture. 1.5 ml. of NaOH (sodium hydroxide) aqueous solution is then introduced to the coal-oil admixture and the mixture is heated at about 150° F. A thick gel, (having a fluffy appearance, which does not attach to the sidewalls of the vessel) and which is readily flowing upon being subjected to shearing or pumping forces, is formed. The resultant coal-oil mixture is highly storage stable, e.g. shelf life of 3 months or more and contains 60 parts, by weight, coal to 40 parts by weight oil.

EXAMPLE 7

140 grams of No. 6 fuel oil is mixed with 5.6 grams of tall oil and the mixture is heated to about 200° F. 160 grams (dry weight) of pulverized Kittanning Seam coal having a moisture content of 20% is mixed into the heated tall oil-fuel oil mixture. 1.5 ml. of an NaOH (sodium hydroxide) aqueous solution is then introduced to the coal-oil admixture and the mixture is heated at about 150° F. The remainder of the coal, i.e., 100 grams, dry weight, is then slowly added to the mixture under paddle type mixing conditions, for example as provided by an Eastern Heavy Duty Mixer MODEL 5UB. A thick gel, (having a fluffy appearance, which does not attach to the sidewalls of the vessel) and which is readily flowing upon being subjected to shearing or pumping forces, is formed. The resultant coal-oil mixture is highly storage stable, e.g. shelf life of 3 months or more and contains 65 parts, by weight, coal to 35 parts by weight oil.

EXAMPLE 8

140 grams of No. 6 fuel oil is mixed with 5.6 grams of tall oil and the mixture is heated to about 200° F. 160 grams (dry weight) of pulverized (Wells Blend) coal having a moisture content of 20% is mixed into the heated tall oil-fuel oil mixture. 1.9 grams of monoethanolamine is then introduced to the coal-oil admixture and the mixture is heated at about 150° F. The remainder of the coal, i.e., 100 grams, dry weight, is then slowly added to the mixture under paddle type mixing conditions, for example as provided by an Eastern Heavy Duty Mixer MODEL 5UB. A thick gel, (having a fluffy appearance, which does not attach to the sidewalls of the vessel) and which is readily flowing upon being subjected to shearing or pumping forces, is formed. The resultant coal-oil mixture is highly storage stable, e.g. shelf life of 3 months or more and contains 65 parts, by weight, coal to 35 parts by weight oil.

EXAMPLE 9

120 grams of No. 6 fuel oil is mixed with 4.8 grams of tall oil and the mixture is heated to about 200° F. 180 grams (dry weight) of pulverized (Wells Blend) coal having a moisture content of 20% is mixed into the heated tall oil-fuel oil mixture. 2.4 ml. of a 28% $NH_4OH$ (ammonium hydroxide) aqueous solution is then introduced to the coal-oil admixture and the mixture is heated at about 150° F. The remainder of the coal, i.e., 100 grams, dry weight, is then slowly added to the mixture under paddle type mixing conditions, for example as provided by an Eastern Heavy Duty Mixer MODEL 5UB. A thick gel, (having a fluffy appearance, which does not attach to the sidewalls of the vessel) and which is readily flowing upon being subjected to shearing or pumping forces, is formed. The resultant coal-oil mixture is highly storage stable, e.g. shelf life of 3 months or more and contains 70 parts, by weight, coal to 30 parts by weight oil.

EXAMPLE 10

108 grams of No. 6 fuel oil and 12 grams of No. 2 Fuel Oil is mixed with 12.0 grams of tall oil and the mixture is heated to about 200° F. 180 grams (dry weight) of pulverized (Wells Blend) coal having a moisture content of 25% is mixed into the heated tall oil-fuel oil mixture. 4.8 grams of monoethanolamine is then introduced to the coal-oil admixture and the mixture is heated at about 150° F. The remainder of the coal, i.e., 100 grams, dry weight, is then slowly added to the mixture under paddle type mixing conditions, for example as provided by an Eastern Heavy Duty Mixer MODEL 5UB. A thick gel, (having a fluffy appearance, which does not attach to the sidewalls of the vessel) and which is readily flowing upon being subjected to shearing or pumping forces, is formed. The resultant coal-oil mixture is highly storage stable, e.g. shelf life of 3 months or more and contains 70 parts, by weight, coal to 30 parts by weight oil.

EXAMPLE 11

160 grams of No. 2 fuel oil is mixed with 4.8 grams of tall oil and the mixture is heated to about 200° F. 240 grams (dry weight) of pulverized Pocohontas coal having a moisture content of 20% is mixed into the heated tall oil-fuel oil mixture. 1.5 ml. of NaOH (sodium hydroxide) aqueous solution is then introduced to the coal-oil admixture and the mixture is heated at about 150° F. A thick gel, (having a fluffy appearance, which does not attach to the sidewalls of the vessel) and which is readily flowing upon being subjected to shearing or pumping forces, is formed. The resultant coal-oil mixture is highly storage stable, e.g. shelf life of 3 months or more and contains 60 parts, by weight, coal to 40 parts by weight oil.

EXAMPLE 12

140 grams of Gulf No. 6 fuel oil is mixed with 5.6 grams of tall oil and the mixture is heated to about 200° F. 160 grams (dry weight) of pulverized Pittsburgh Seam coal having a moisture content of 22% is mixed into the heated tall oil-fuel oil mixture. 1.9 grams of monoethanolamine is then introduced to the coal-oil admixture and the mixture is heated to about 150° F. The remainder of the coal, i.e., 100 grams, dry weight, is then slowly added to the mixture under paddle type mixing conditions, for example as provided by an Eastern Heavy Duty Mixer, MODEL 5UB. A thick gel, (having a fluffy appearance, which does not attach to the sidewalls of the vessel) and which is readily flowing upon being subjected to shearing or pumping forces, is formed. The resultant coal-oil mixture is highly storage stable, e.g. shelf life of 3 months or more and contains 65 parts, by weight, coal to 35 parts by weight oil.

Obviously other modifications and variations of the present invention are possible in light of the above teachings. It is, therefore, to be understood that changes may be made in the particular embodiments of this invention which are within the full intended scope of this invention as described by the appended claims.

What is claimed is:

1. A method for forming a stabilized, high solids content, coal-oil mixture, said method comprising the steps of:

(i) admixing a saturated or unsaturated fatty acid with oil and heating the admixture to an elevated temperature;

(ii) admixing at least about 75% of the total coal content to be employed with the mixture resulting from step (i);

(iii) adding a gel forming amount of a base selected from the group consisting of an alkali metal hydroxide, an alkaline earth hydroxide, ammonium hydroxide, an amine and mixtures thereof to the mixture resulting from step (ii); and (iv) admixing the remainder of the coal content with the mixture resulting from step (iii) and heating the resultant admixture to an elevated temperature thereby forming a stabilized, high solids content coal-oil mixture.

2. The method of claim 1 wherein said coal in steps (ii) and (iv) has a moisture content of from about 10 to about 30%, based on the weight of dry coal.

3. The method of claim 1 wherein said coal in steps (ii) and (iv) has been wet with water prior to admixing with said oil.

4. The method of claim 1 wherein the saturated or unsaturated fatty acid has the general formula $$RC(=O)-OH$$

wherein R is a saturated or olefinically unsaturated organic radical having from 1 to about 30 carbon atoms.

5. The method of claim 1 wherein said elevated temperature in step (i) is in the range of from about 130° to about 210° F.

6. The method of claim 1 wherein said elevated temperature in step (iv) is in the range of from about 130° to about 170° F.

7. The method of claim 1 wherein a polymerization catalyst is added during any of steps i–iv.

8. The method of claim 1 wherein the fatty acid is tall oil and the gel forming base is ammonium hydroxide.

9. A method for forming a stabilized, high solids content coal-oil mixture, said method comprising the steps of:

(i) admixing tall oil with a fuel oil and heating the mixture to a temperature in the range of from about 130° to about 210° F.;

(ii) admixing, from about 10 to about 80% of the total coal content to be added, to the admixture of step (i);

(iii) adding a gel forming amount of ammonium hydroxide to the admixture resulting from step (ii); and (iv) admixing the remaining portion of the coal to the admixture resulting from step (iii) and heating the mixture to a temperature of from about 130° to about 170° F. thereby forming a stable, high solids content, coal-oil mixture.

10. The method of claim 8 wherein said coal in steps (ii) and (iv) has a moisture content of from about 10 to about 30% based on the weight of dry coal.

11. The method of claim 8 wherein a polymerization catalyst selected from the group consisting of cupric nitrate, hydrogen peroxide and mixtures thereof is added during any of steps (i) to (iv).

12. A method for forming a stabilized, high solids content, coal-oil mixture, said method comprising the steps of:

(i) admixing a saturated or unsaturated fatty acid with oil and heating the admixture to an elevated temperature;

(ii) admixing from about 10 to about 80% of the total coal content to be employed with the mixture resulting from step (i);

(iii) adding a gel forming amount of a base selected from the group consisting of an alkali metal hydroxide, an alkaline earth hydroxide, ammonium hydroxide, an amine and mixtures thereof to the mixture resulting from step (ii); and (iv) admixing the remainder of the coal content to the mixture resulting from step (iii) and heating the resultant admixture to an elevated temperature thereby forming a stabilized, high solids content coal-oil mixture wherein said coal in steps (ii) and (iv) has a moisture content of from about 20 to about 30%, based on the weight of dry coal.

13. The method of claim 12 wherein said coal in steps (ii) and (iv) has been wet with water prior to admixing with said oil.

14. The method of claim 12 wherein the fatty acid is tall oil and the gel forming base is ammonium hydroxide.

15. A method for forming a stabilized, high solids content coal-oil mixture, said method comprising the steps of:

(i) admixing tall oil with a fuel oil and heating the mixture to a temperature in the range of from about 130° to about 210° F.;

(ii) admixing, from about 10 to about 80% of the total coal content to be added, to the admixture of step (i);

(iii) adding a gel forming amount of ammonium hydroxide to the admixture resulting from step (ii); and (iv) admixing the remaining portion of the coal to the admixture resulting from step (iii) and heating the mixture to a temperature of from about 130° to about 170° F. thereby forming a stable, high solids content, coal-oil mixture wherein said coal in steps (ii) and (iv) has a moisture content of from about 20 to about 30% based on the weight of dry coal.

* * * * *